US008047032B1

(12) United States Patent
Liu et al.

(10) Patent No.: US 8,047,032 B1
(45) Date of Patent: Nov. 1, 2011

(54) COMBINATION LOCK WITH TWO DIAL PLATES

(75) Inventors: Chao-Hsuan Liu, Taichung County (TW); Yu-Chun Liu, Taichung County (TW); Wen-Kuei Liu, Taichung County (TW)

(73) Assignees: Chao-Hsuan Liu, Taichung County; Yu-Chun Liu, Taichung County ( * ) Notice: Subject to any disclaimer, the term of this patent is extended or adjusted under 35 U.S.C. 154(b) by 0 days.

(21) Appl. No.: 12/836,718

(22) Filed: Jul. 15, 2010

(51) Int. Cl.
*E05B 37/08* (2006.01)
*E05B 47/06* (2006.01)
*G07C 9/00* (2006.01)

(52) U.S. Cl. ..... 70/303 A; 70/431; 70/310

(58) Field of Classification Search ..... 70/22, 23, 70/24, 25, 26, 27, 28, 29, 30, 292, 293, 327, 70/328, 329, 332, 321, 322
See application file for complete search history.

(56) References Cited

U.S. PATENT DOCUMENTS

| | | | | | |
|---|---|---|---|---|---|
| 1,201,993 | A * | 10/1916 | Vance | 70/328 |
| 1,416,855 | A * | 5/1922 | Michalek | 70/310 |
| 1,950,503 | A * | 3/1934 | Mahon | 70/310 |
| 3,611,761 | A * | 10/1971 | Atkinson | 70/310 |
| 3,952,562 | A * | 4/1976 | Snow | 70/324 |
| 4,104,896 | A * | 8/1978 | Hahn | 70/310 |
| 7,383,708 | B2 * | 6/2008 | Liu et al. | 70/301 |
| 2011/0061430 | A1 * | 3/2011 | Liu et al. | 70/431 |

* cited by examiner

*Primary Examiner* — Lloyd Gall
*Assistant Examiner* — David E Sosnowski

(57) ABSTRACT

A combination lock includes an outer case with an inner case received therein and the outer case has a chamber which communicates with a passage in which a latch is received. A spring is mounted to the latch and provides a force to move the latch in a direction away from the chamber. A front unit having two disks is located in the first chamber and a rear unit having two disks is located in the second chamber. The two disks of the front unit drive each other and the two disks of the rear unit drive each other. A first dial plate drives one of the disks of the front unit and a second dial plate drives one of the disks of the rear unit. When the notches are in alignment with each other, the end piece of the latch can pass through the notches and the lock is unlocked.

7 Claims, 7 Drawing Sheets

COMBINATION LOCK WITH TWO DIAL PLATES

FIELD OF THE INVENTION

The present invention relates to a combination lock, and more particularly, to a combination lock having two dial plates which provides highly anti-theft feature.

BACKGROUND OF THE INVENTION

The conventional locks comprises mechanical locks and electronic locks, wherein the electronic locks are easily unlocked by proper scanning apparatus and the mechanical locks do not have the shortcomings as the electronic locks. The mechanical locks comprise combination locks and conventional mechanical locks using keys. The combination locks are more convenient for the uses and the numbers are memorized by the users and the thieves are difficult to know the numbers. However, the conventional combination lock includes multiple digit rings which includes only 10 digits and the numbers that are able to unlock can be achieved by rotating the digit rings in either of two directions, so that the possible combination of the numbers are limited.

The present invention intends to provide a combination lock which includes two dial plates and each dial plate control two disks so as to have more number of combinations.

SUMMARY OF THE INVENTION

The present invention relates to a combination lock and comprises an outer case, an inner case and a cover, wherein the outer case has a chamber and a passage communicates with the chamber. The inner case has a first chamber and a second chamber, and a recess is defined through a wall of the inner case. A latch unit has a latch and a spring which is mounted to the latch which is movably inserted in the passage. An end piece extends from the first end of the latch and is movable in the recess of the inner case. A front unit has a tube and multiple disks are mounted to the tube. A first end of the tube is rotatably connected to the inner case and a second end of the tube rotatably extends through a closed end of the chamber. The disks drive each other and are rotatable in the first chamber. Each disk has a notch through which the end piece passes. One of the disks is fixed to the tube and the rest of the disks are rotatable relative to the tube. A first dial plate is located on outside of the chamber and fixed to the tube. A rear unit has a shaft and multiple disks are mounted to the shaft. The shaft rotatably extends through the tube. A first end of the shaft extends into the second chamber and a second end of the shaft extends through the first dial plate. The disks drive each other and are rotatable in the second chamber. Each disk has a notch through which the end piece passes. One of the disks is fixed to the shaft and the rest of the disks are rotatable relative to the shaft. A second dial plate is located on outside of the first dial plate and fixed to the shaft.

The primary object of the present invention is to provide a combination lock wherein the latch is moved only when all of the notches of the disks of the front and rear units are located in alignment with each other. The disks can only be rotated in one direction by rotating the first and second dial plates.

Another object of the present invention is to provide a combination lock wherein the first dial plate is larger than the second dial plate, so that the digits on the first dial plate can be more so as to provide more sets of combinations.

Yet another object of the present invention is to provide a combination lock wherein there is a resilient plate which contacts the outer periphery of each of the disks so that when the disks are rotated, the friction between the resilient plate and the disks generates click sound to avoid the thieves from checking the position of the notches.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
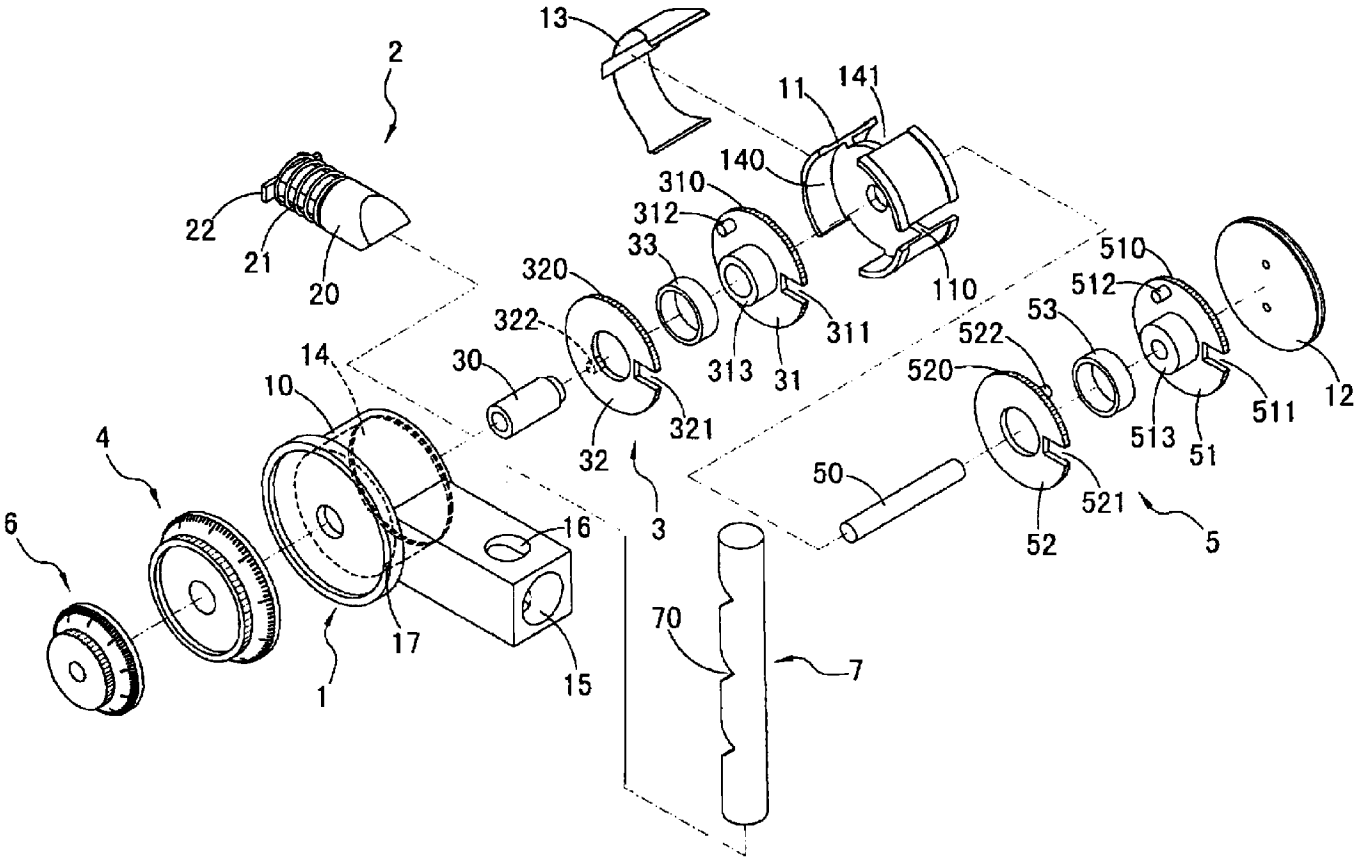
FIG. 1 is an exploded view to show the combination lock of the present invention.
Figure 2:
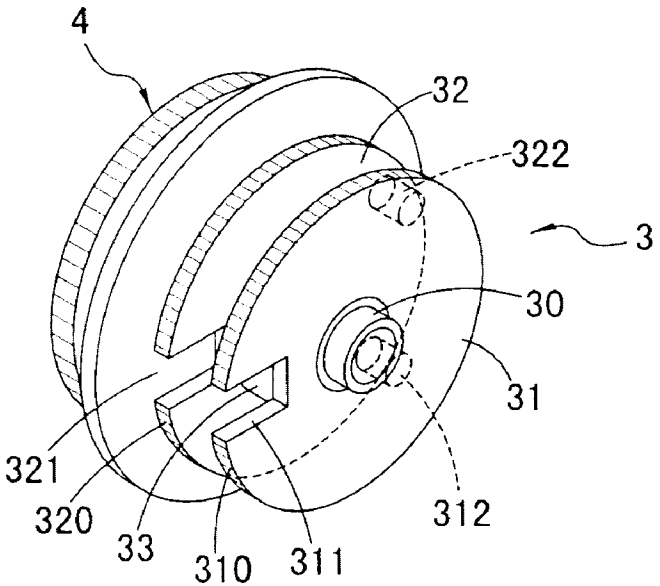
FIG. 2 is a perspective view to show the first dial plate and the front unit of the combination lock of the present invention.
Figure 3:
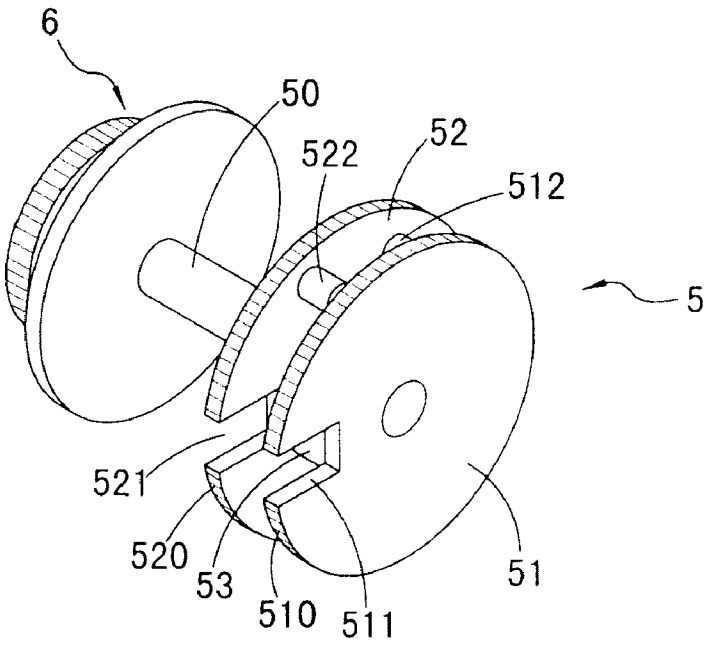
FIG. 3 is a perspective view to show the second dial plate and the rear unit of the combination lock of the present invention.
Figure 4:
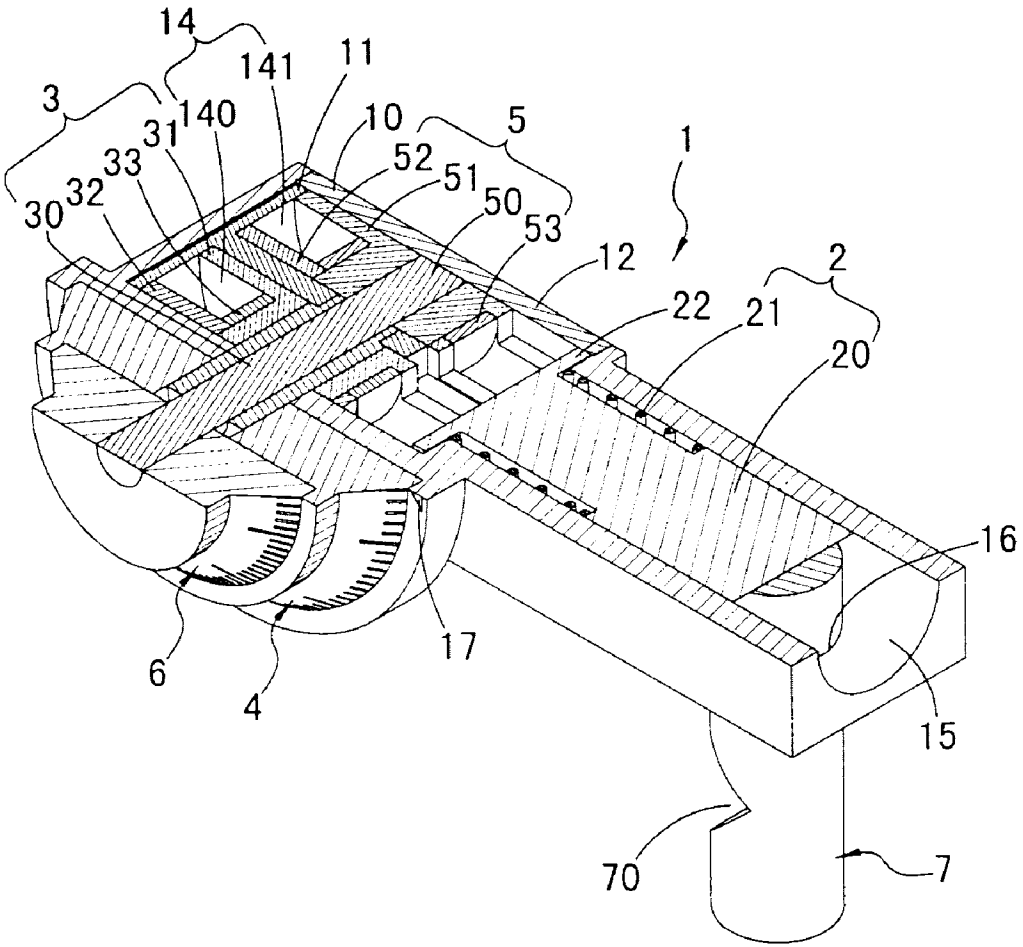
FIG. 4 is a cross sectional view of the combination lock of the present invention.
Figure 5:
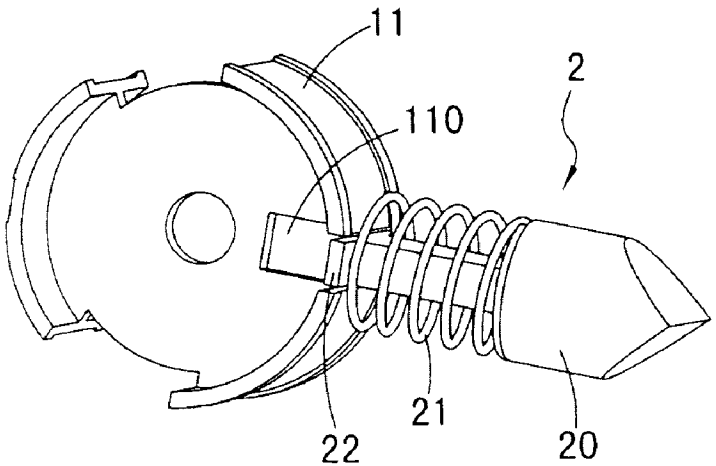
FIG. 5 shows that the latch and the inner case when the lock is locked.
Figure 6:
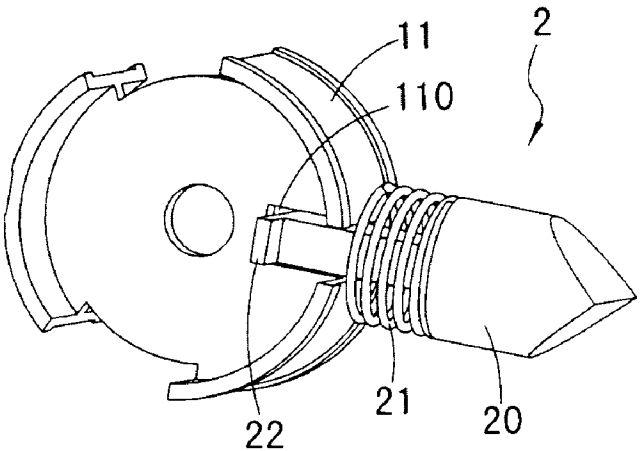
FIG. 6 shows that the latch and the inner case when the lock is unlocked.
Figure 7:
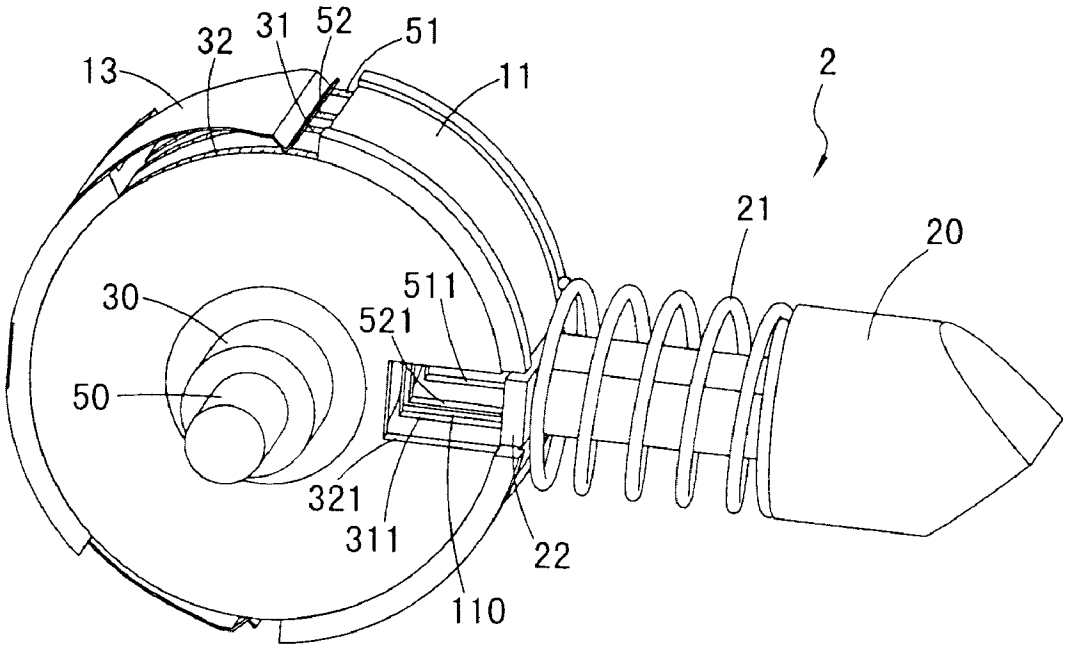
FIG. 7 is an enlarged perspective view of the inside of the combination lock of the present invention.

Referring to FIGS. 1 to 7, the combination lock of the present invention comprises a case unit 1 having an outer case 10, an inner case 11 and a cover 12. The outer case 11 has a chamber 14 and a passage 15 communicates with the chamber 14. The outer case 10 has a through hole 16 which communicates with the passage 15. The chamber 14 has an open end and a closed end. The inner case 11 has a first chamber 140 and a second chamber 141, and a recess 110 is defined through a wall of the inner case 11. The cover 12 is securely connected to the open end and seals the second chamber 141. The outer case 10 has an alignment mark 17 on a front end thereof.

A latch unit 2 has a latch 20 and a spring 21 which is mounted to the latch 20. The latch 20 is movably inserted in the passage 15 and has a first end thereof located in the chamber 14. An end piece 22 extends radially outward from the first end of the latch 20 and is movable in the recess 110 of the inner case 11. The spring 21 provides a force to move the latch 20 in a direction away from the chamber 14. The length of the end piece 22 is longer than the width of the passage 15. The spring 21 is a compression spring and two ends of the spring 21 are respectively in contact with the end piece 22 and the inner case 11.

A front unit 3 has a tube 30, a first disk 31, a second disk 32 and a first washer 33. The tube 30 has a first end thereof rotatably connected to the inner case 11 and a second end of the tube 30 rotatably extends through the closed end of the chamber 14. The first disk 31 is fixedly mounted to the tube 30 and has a first tubular portion 313 extending therefrom. The second disk 32 is rotatably mounted to the first tubular portion 313. The first disk 31 has a first driving protrusion 312 on a facing side thereof and the second disk 32 has a second driving protrusion 322 on a facing side thereof which faces the facing side of the first disk 31. The first driving protrusion 312 drives the second driving protrusion 322. The first and second disks 31, 32 are rotatable in the first chamber 140. The first disk 31 has a first notch 311 defined in an outer periphery thereof and the second disk 32 has a second notch 321 defined in an outer periphery thereof. The end piece 22 can pass through the aligned first and second notches 311, 321. The first washer 33 is mounted to the first tubular portion 313 of the first disk 31 and located between the first and second disks 31, 32. A first dial plate 4 is located on outside of the closed end of the chamber 14 and fixed to the tube 30.

A rear unit 5 has a shaft 50, a third disk 51, a fourth disk 52 and a second washer 53. The third disk 51 is fixedly mounted to the shaft 50 and has a second tubular portion 513 extending therefrom. The fourth disk 52 is rotatably mounted to the second tubular portion 513. The third disk 51 has a third driving protrusion 512 on a facing side thereof and the fourth disk 52 has a fourth driving protrusion 522 on a facing side thereof which faces the facing side of the third disk 51. The third driving protrusion 512 drives the fourth driving protrusion 522. The shaft 50 rotatably extends through the tube 30. A first end of the shaft 50 extends into the second chamber 141 and a second end of the shaft 50 extends through the first dial plate 4. The third and fourth disks 51, 52 are rotatable in the second chamber 141. The third disk 51 has a third notch 511 defined in an outer periphery thereof and the fourth disk 52 has a fourth notch 521 defined in an outer periphery thereof. The end piece 22 can pass through the aligned third and fourth notches 511, 521. The second washer 53 is mounted to the second tubular portion 513 of the third disk 5 and located between the third and fourth disks 51, 52. A second dial plate 6 is located on outside of the first dial plate 4 and fixed to the shaft 50.

Each of the disks 31, 32, 51, 52 of the front and rear units 3, 5 has serrated surfaces 310, 320, 510, 520 defined in the outer periphery thereof. The case unit 1 has a resilient plate 13 which has at least one side contacting the outer peripheries of the disks 31, 32, 51, 52. The alignment mark 17 on the outer case 10 faces the first dial plate 4. The first dial plate 4 and the second dial plate 6 each have digits arranged as a circle on a side thereof.

A lock bar 7 extends through the through hole 16 and has multiple engaging recesses 70, the latch 20 is engaged with one of the engaging recesses 70 when the combination lock is locked.

When any one of the first, second, third and fourth notches 311, 321, 511, 521 is not in alignment with the recess 110 of the inner case 11, the end piece 22 of the latch 20 cannot move in the passage 15 so that the engagement between the latch 20 and one of the engaging recesses 70 is not released, and the combination lock is locked.

Figure 8:
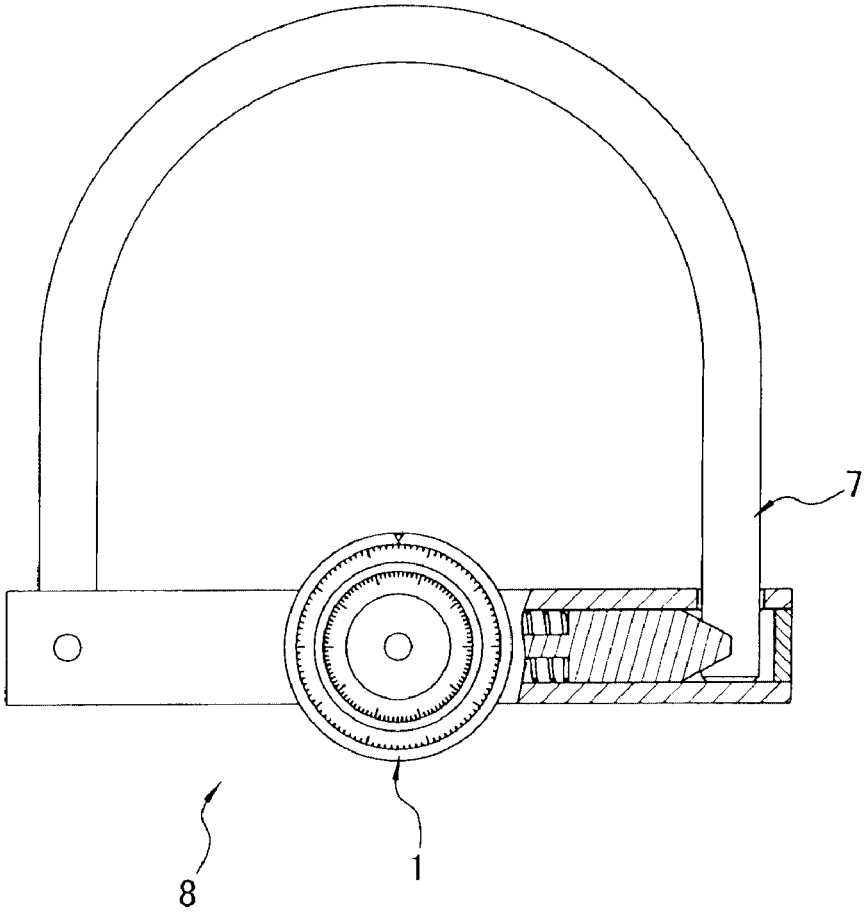
FIG. 8 shows that the combination lock is used as an automobile lock.
Figure 9:
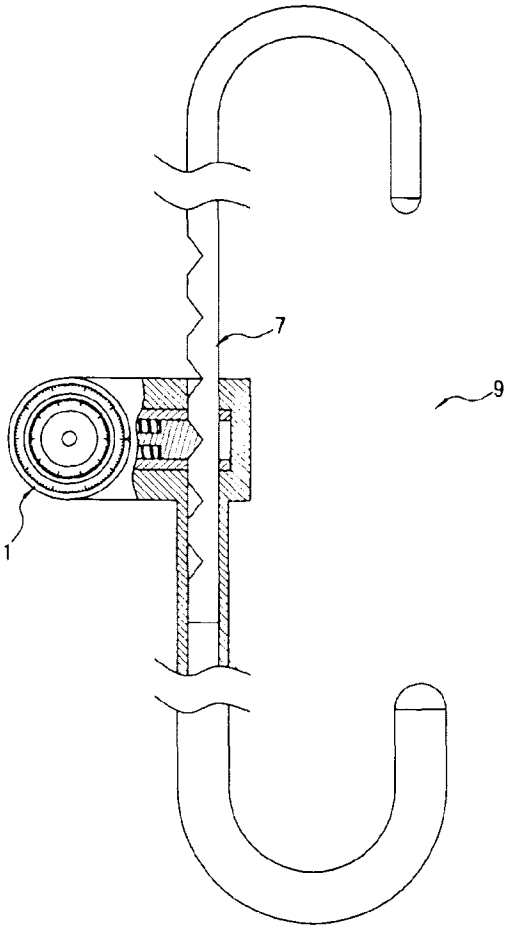
FIG. 9 shows that the combination lock is used as a vehicle lock.

When rotating the first dial plate 4 either counter clockwise or clockwise, the first disk 31 fixed to the tube 30 is rotated and the second disk 32 is rotated by the first driving protrusion 312 driving the second driving protrusion 322. When the first dial plate 4 is rotated to the first correct number or position, the second notch 321 is in alignment with the recess 110, and the first dial plate 4 is rotated to the second number or position, the first notch 311 of the first disk 31 is located in alignment with the recess 110. The second dial plate 6 is then rotated to the first correct number or position, the shaft 50 and the third disk 51 are rotated and the fourth disk 52 is rotated by the third driving protrusion 512 driving the fourth driving protrusion 522. The fourth notch 521 of the fourth disk 52 is located in alignment with the recess 110 and the second dial plate 6 is rotated to the second number or position, the third notch 511 of the third disk 51 is located in alignment with the recess 110. When all of the notches 311, 321, 511, 521 are located in alignment with the recess 110, the end piece 22 of the latch 20 passes through the notches 311, 321, 511, 521 and the recess 110, so that the latch 20 is able to move in the passage 15 to unlock the lock. The number of the digits of the front unit 3 and the rear unit 5 can be increased or reduced as needed. FIG. 8 shows that the combination lock is used as an automobile lock 8, and FIG. 9 shows that the combination lock is used as a vehicle lock 9.

While we have shown and described the embodiment in accordance with the present invention, it should be clear to those skilled in the art that further embodiments may be made without departing from the scope of the present invention.

What is claimed is:

1. A combination lock comprising:

a case unit having an outer case, an inner case and a cover, the outer case having a chamber and a passage which communicates with the chamber, the chamber having an open end, the inner case having a first chamber and a second chamber, a recess defined through a wall of the inner case, the cover connected to the open end and sealing the second chamber;

a latch unit having a latch and a spring which is mounted to the latch, the latch movably inserted in the passage and having a first end thereof located in the chamber of the outer case, an end piece extending from the first end of the latch and movable in the recess of the inner case, the spring providing a force to move the latch in a direction away from the chamber of the outer case;

a front unit having a tube and multiple disks which are mounted to the tube, a first end of the tube rotatably connected to the inner case and a second end of the tube rotatably extending through a closed end of the chamber, the disks driving each other and rotatable in the first chamber, each disk having a notch through which the end piece passes, one of the disks fixed to the tube and the rest of the disks rotatable relative to the tube;

a first dial plate located on the outside of the closed end of the chamber of the outer case and fixed to the tube;

a rear unit having a shaft and multiple disks which are mounted to the shaft, the shaft rotatably extending through the tube, a first end of the shaft extending into the second chamber and a second end of the shaft extending through the first dial plate, the disks driving each other and rotatable in the second chamber, each disk having a notch through which the end piece passes, one of the disks of the rear unit fixed to the shaft and the rest of the disks rotatable relative to the shaft, and a second dial plate located on the outside of the first dial plate and fixed to the shaft.

2. The combination lock as claimed in claim 1, wherein each of the disks of the front and rear units has serrated surfaces defined in an outer periphery thereof, the case unit has a resilient plate which has at least one side contacting the outer peripheries of the disks.

3. The combination lock as claimed in claim 2, wherein the front unit comprises a first disk and a second disk, the first disk is fixed to the tube and has a first tubular portion, the second disk is rotatably mounted to the first tubular portion, the first disk has a first driving protrusion on a facing side thereof and the second disk has a second driving protrusion on a facing side thereof which faces the facing side of the first disk, the first and second driving protrusions drive each other, the rear unit comprises a third disk and a fourth disk, the third disk is fixed to the shaft and has a second tubular portion, the fourth disk is rotatably mounted to the second tubular portion, the third disk has a third driving protrusion on a facing side thereof and the fourth disk has a fourth driving protrusion on a facing side thereof which faces the facing side of the third disk, the third and fourth driving protrusions drive each other.

4. The combination lock as claimed in claim 3, wherein the front unit comprises a first washer mounted to the first tubular portion of the first disk and located between the first and second disks, the rear unit comprises a second washer mounted to the second tubular portion of the third disk and located between the third and fourth disks.

5. The combination lock as claimed in claim 4, wherein the spring is a compression spring and two ends of the spring are respectively in contact with the end piece and the inner case.

6. The combination lock as claimed in claim 1, wherein the outer case has an alignment mark which faces the first dial plate, the first dial plate and the second dial plate each have digits arranged as a circle on a side thereof.

7. The combination lock as claimed in claim 6 further comprising a lock bar and the outer case has a through hole which communicates with the passage, the lock bar extends through the through hole and has at least one engaging recess with which the latch is engaged.

* * * * *